US007584916B2

(12) United States Patent
Shaw

(10) Patent No.: US 7,584,916 B2
(45) **Date of Patent: *Sep. 8, 2009**

(54) CUTTING RING ELEMENT FOR A CENTRIFUGAL CHOPPER PUMP

(75) Inventor: James G. Shaw, Draper, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 74 days.

This patent is subject to a terminal disclaimer.

(21) Appl. No.: 11/137,168

(22) Filed: May 25, 2005

(65) Prior Publication Data

US 2006/0266856 A1 Nov. 30, 2006

(51) Int. Cl.
*B02B 1/00* (2006.01)
*B02C 11/08* (2006.01)
*B07B 4/00* (2006.01)

(52) U.S. Cl. ..... 241/46.06; 241/121

(58) Field of Classification Search ..... 241/46.013, 241/46.11, 46.06; 415/121.1
See application file for complete search history.

(56) References Cited

U.S. PATENT DOCUMENTS 2,824,702 A * 2/1958 Lee ..... 241/46.013
3,155,046 A 11/1964 Vaughan
3,188,012 A * 6/1965 Shive et al. ..... 241/46.013
3,584,800 A * 6/1971 Dodd et al. ..... 241/46.06
3,774,323 A 11/1973 Vaughn
3,973,866 A 8/1976 Vaughan
4,378,093 A * 3/1983 Keener ..... 241/46.017
4,527,947 A 7/1985 Elliott
4,778,336 A * 10/1988 Husain ..... 415/121.1
4,840,384 A 6/1989 Dorsch
4,842,479 A 6/1989 Dorsch
5,044,566 A * 9/1991 Mitsch ..... 241/46.04
5,076,757 A 12/1991 Dorsch
5,256,032 A 10/1993 Dorsch
5,456,580 A 10/1995 Dorsch
5,460,482 A 10/1995 Dorsch
5,460,483 A * 10/1995 Dorsch ..... 415/121.1
6,190,121 B1 2/2001 Hayward et al.
6,224,331 B1 * 5/2001 Hayward et al. ..... 415/121.1
7,159,806 B1 * 1/2007 Ritsema ..... 241/46.06
2005/0053461 A1 * 3/2005 Doering et al. ..... 415/121.1

* cited by examiner

*Primary Examiner*—Bena Miller
(74) *Attorney, Agent, or Firm*—Morriss O'Bryant Compagni

(57) ABSTRACT

A cutting ring element for a centrifugal pump of the chopper type comprises a ring-like structure having at least one cutting member positioned along the ring-like structure and extending outwardly therefrom. The cutting ring element is structured to be positioned adjacent the drive side of an impeller having cutting structures associated with the drive side of the impeller which interact with the cutting ring element to chop and reduce the size of entrained solids in a pumped fluid, or slurry, to prevent such solids from infiltrating behind the impeller.

7 Claims, 3 Drawing Sheets

CUTTING RING ELEMENT FOR A CENTRIFUGAL CHOPPER PUMP

BACKGROUND OF THE INVENTION

1. Field of the Invention

This invention relates to centrifugal pumps of the type known as chopper pumps, which are structured to process fluids containing large-sized solids that must be cut or chopped by the pump. Specifically, this invention relates to a cutting ring element which is configured to work in tandem with an appropriately configured impeller to process entrained solids and exclude them from the rear portion of the impeller, and thus the seal of the pump.

2. Description of Related Art

Centrifugal pumps of the chopper type are used in many and varied industries to process fluids that contain larger-sized solids, such as plastics or animal byproducts. Chopper pumps are typically characterized by having an impeller that is structured to contact a cutting element positioned adjacent the vanes of the impeller to exert a cutting or chopping action on the solid material entering the pump. The impeller and cutting structures positioned on the suction side of chopper pumps process the majority of the solids content to a size that can be moved through the pump. However, some solids tend to also move toward the drive side, or back, of the impeller and may move inwardly toward the drive shaft of the pump.

When solids move toward the drive side, or back, of the impeller and inwardly toward the drive shaft, debris can become wrapped around the drive shaft and impede the operation of the pump. This is especially the case with fluids containing stringy solids. Debris behind the impeller can cause a build up in heat and wear on the impeller and can impede the cooling and lubrication of the seal elements. Solid material may infiltrate the seal and cause further problems with pump operation. Thus, some known chopper pumps have employed flushing mechanisms to clean behind the impeller.

Other known chopper pumps have used impellers designed with cutting elements located on or near the back side of the impeller and about the drive shaft to chop solid material in the location of the drive shaft. An example of an impeller and cutting element of the type described is disclosed in U.S. Pat. No. 5,460,482 to Dorsch. Some chopper pumps also use restrictor bushings around the shaft to keep larger solids away from the seal, as described in the '482 patent to Dorsch. Yet other chopper pumps use an open impeller design to reduce pressure behind the impeller so that solids are not drawn toward the back side of the impeller.

Prior art chopper pumps which employ a cutting element on the back side of the impeller require that the cutting element be positioned adjacent the impeller hub and/or in very close proximity to the drive shaft. As such, debris in the fluid, especially stringy material, can infiltrate all the way to the drive shaft and seal assembly before any chopping or cutting of the material takes place.

Thus, it would be advantageous in the art to provide an impeller and cutting element configuration in a centrifugal chopper pump that processes and excludes debris from behind the impeller before the debris can reach the drive shaft and seal assembly, thereby improving pump operation and the life of the pump. Co-pending U.S. application Ser. No. 10/893,506, which is commonly owned with the present application, discloses an impeller and cutting elements that are configured to interact in a manner that chops or cuts debris near the peripheral edge of the drive side of the impeller to effectively reduce and exclude debris from contact with the drive shaft and any associated sealing assemblies.

While the impeller and cutting elements disclosed in U.S. application Ser. No. 10/893,506 are particularly suitable for their intended purpose, the configuration of the cutting elements is such that the individual cutting elements must be replaced individually when worn. It would be advantageous, therefore, to provide a more simplified and cost-effective configuration for the cutting elements located to interact on the drive side of the impeller.

BRIEF SUMMARY OF THE INVENTION

In accordance with the present invention, a cutting ring element is provided for use in chopper type centrifugal pumps and is configured for positioning relative to the impeller of the pump to interact in a manner that chops or cuts debris near the peripheral edge of the drive side of the impeller to effectively reduce and exclude debris from contact with the drive shaft and any associated sealing assemblies. While the cutting ring element of the present invention is described herein with respect to use in centrifugal pumps of the chopper type, the cutting ring element may be adapted for use in types of centrifugal pumps other than chopper pumps.

The present invention comprises a cutting ring element that is configured for positioning in a centrifugal pump adjacent to the drive side of the impeller to interact with cutting structures that are formed on the drive side of the impeller. An impeller of the type described, for use in chopper pumps, is disclosed in co-pending application Ser. No. 10/893,506, the content and disclosure of which are incorporated herein by reference. The impeller, having a drive side oriented away from the inlet of the pump, is particularly configured with cutting structures that interact with the cutting ring element of the present invention. The cutting structures on the drive side of the impeller, and with which the cutting ring element of the present invention interact, are positioned toward the outer periphery of the impeller to provide chopping and cutting of solids near the periphery of the impeller. The peripherally-located cutting structures of the impeller are particularly positioned to exclude the chopped debris from the drive side of the impeller, and especially away from the drive shaft and any associated sealing assemblies.

The cutting ring element of the present invention is formed generally as a continuous ring-like structure that has positioned on the ring and extending outwardly therefrom at least one cutting member sized and configured to interact with a cutting structure positioned on an impeller. The cutting member may be of any suitable size, shape or configuration to interact with the particularly sized, shaped or configured cutting structures of the impeller. In one embodiment of the invention, a plurality of cutting members are positioned on the ring-like structure.

The cutting ring element of the present invention is positioned in a centrifugal pump adjacent the drive side of the impeller. The cutting ring element may be structured, therefore, to be positioned against and secured to the pump casing so as to be adjacently positioned next to the impeller. Alternatively, and as described more particularly herein, the cutting ring element may be configured for attachment to a separate back plate that is, in turn, positioned between the pump casing and the drive side of the impeller. Providing the adjacently positioned cutting ring element on a separate plate-like structure, attachable to and separate from the pump casing, has the particular advantage of providing axial adjustment of the cutting ring element relative to the impeller and when installation of the cutting ring element is made as a retrofit to an existing pump. In either construction, however, the ring-like construction of the cutting ring element facilitates the removal and replacement of the cutting member or members when worn due to extended use, and avoids the need to replace individual cutting structures as is presently known in the prior art. The construction of the ring-like member and cutting member or members is more cost-effective as well.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
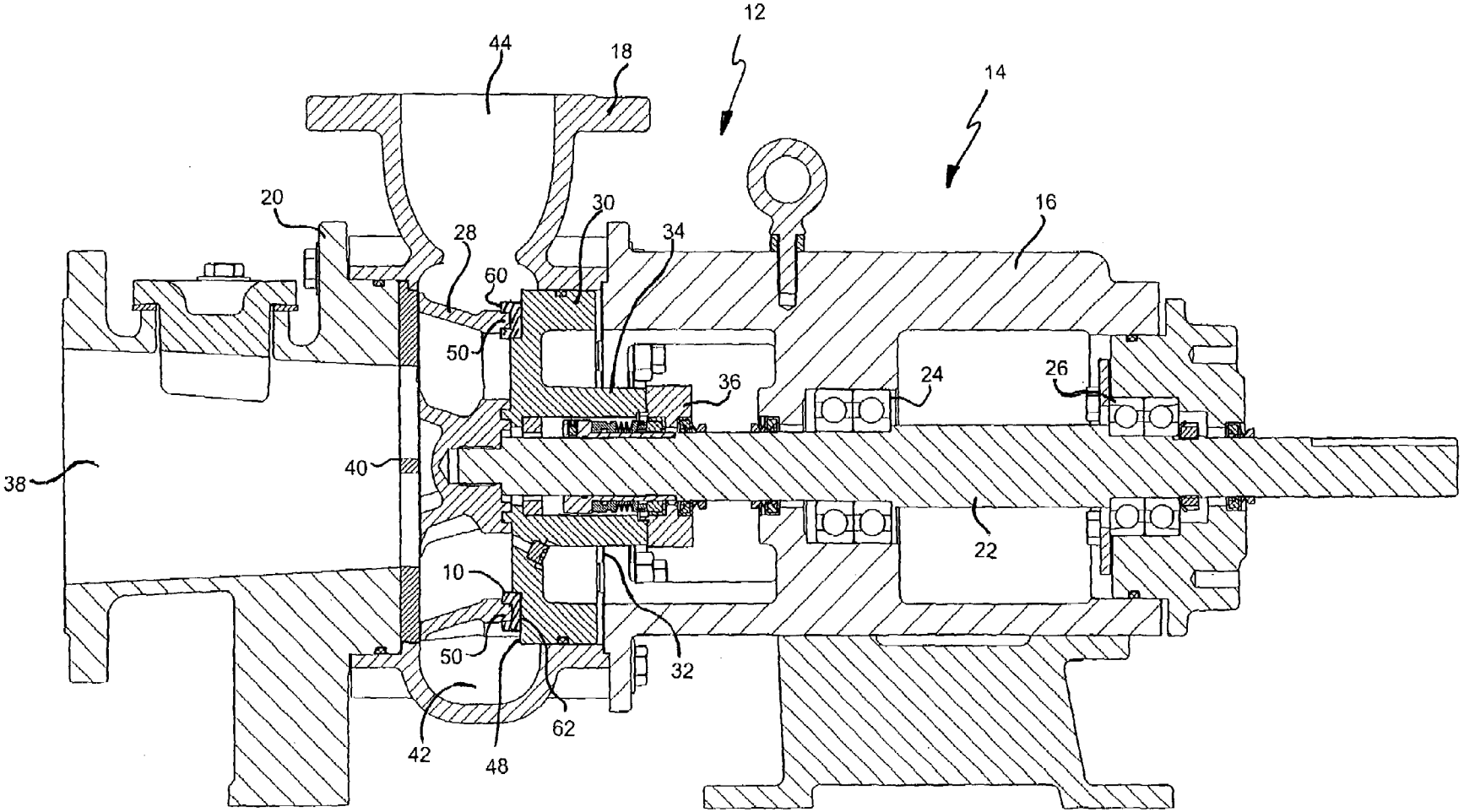
FIG. 1 is a view in longitudinal cross section of a centrifugal pump of the chopper type illustrating an exemplar installation of the cutting ring element of the present invention.

FIG. 1 illustrates in longitudinal cross section one exemplar configuration of a centrifugal chopper pump of the type where the cutting ring element 10 of the present invention is used. The centrifugal pump 12 generally comprises a pump casing 14 that is shown in FIG. 1 as comprising a drive casing 16, a volute casing 18 that is secured to the drive casing 16, and a suction casing 20 that is secured to the volute casing 18.

The drive casing 16 is generally structured to receive a drive shaft 22 which extends through the drive casing 16 and into the volute casing 18. Bearing assemblies 24 and 26 are generally positioned within the drive casing 16 to support the drive shaft 22. The drive shaft 22 extends through the drive casing 16 and is attached to the impeller 28, which is positioned within the volute casing 18.

The drive shaft 22 may also extend through a back plate 30 that is positioned between the drive casing 16 and impeller 28. The back plate 30 is shown secured to an end wall 32 of the drive casing 16, but may be secured to any suitable structure of the pump 12 or portion of the pump casing 14. The back plate 30 may be of any suitable configuration that provides adjacent positioning of cutting elements to interact with the impeller 28. The particular back plate 30 illustrated in FIG. 1 is configured with an annular collar 34 that extends through the end wall 32 of the drive casing 16 and is structured to house a sealing mechanism 36 positioned about the drive shaft 22.

In operation of the pump 12, fluid containing larger-sized solids enters into the pump 12 through an inlet 38 in the suction casing 20. The fluid and solids enter through an intake or chopper plate 40 that is positioned between the suction casing 20 and the impeller 28. The impeller 28 interacts with the chopper plate 40 to cut and chop the solids in the fluid. The fluid and solids slurry then flows into the volute 42 of the pump 12 from where it is expelled through the outlet 44 of the pump 12.

It can be appreciated from the view of FIG. 1 that as the fluid and solids slurry moves into the volute 42, the fluid has a tendency to impact the rear portion 48 of the impeller 28 where it rotates along the back plate 30. It should be noted that the size, dimension and position of the impeller 28 and back plate 30 as shown in FIG. 1 is merely by way of example to illustrate the structure of the invention, and the axial extension of the rear portion 48 of the impeller 28 into the volute 42 may not be as pronounced as illustrated in FIG. 1. Nonetheless, fluid and debris can move behind the impeller 28, and potentially infiltrate to the drive shaft 22 and sealing mechanism 36 of the pump 12.

Thus, the present invention comprises a cutting ring element 10 which, in association with an impeller 28 having cutting structures 50 positioned on the rear portion 48 of the impeller 28, provides cutting action of any debris that may initiate entry behind the impeller 28 before it can infiltrate to the sealing mechanism 36.

The cutting ring element 10 of the invention is shown in FIG. 1 as being positioned on a back plate 30 of the pump 12. This illustration depicts but one means of positioning and securing the cutting ring element 10 adjacent to the impeller 28 and within the pump 12. The cutting ring element 10 may be attached directly to the pump casing 14, such as to the drive casing 16 or volute casing 18. The attachment of the cutting ring element 10 to a back plate 30 provides, however, certain advantages as described more fully hereinafter.

Figure 2:
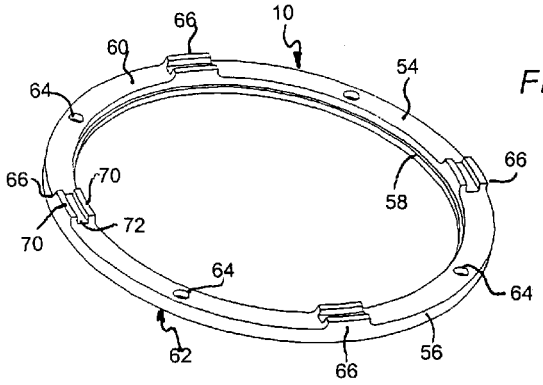
FIG. 2 is a perspective view of the cutting ring element of the present invention.
Figure 4:
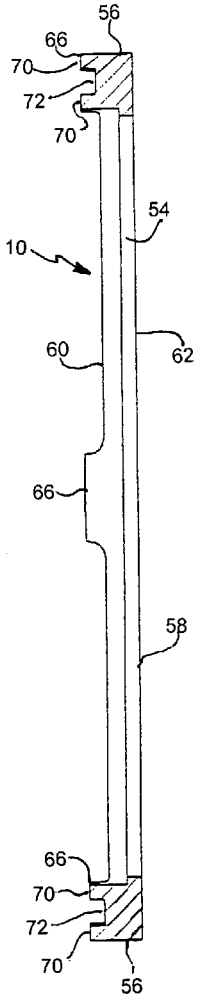
FIG. 4 is a view in cross section of the cutting ring shown in FIG. 3, taken at line 4-4 thereof.
Figure 3:
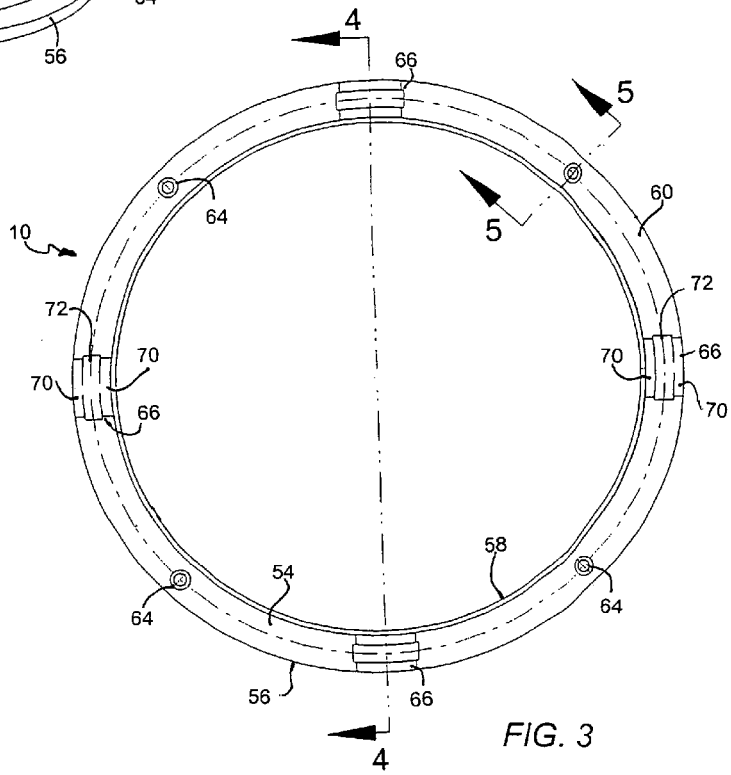
FIG. 3 is a plan view of the cutting ring element shown in FIG. 2.
Figure 5:
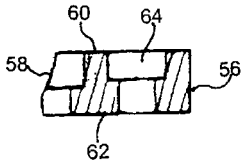
FIG. 5 is a view in cross section of the cutting ring element shown in FIG. 3, taken at line 5-5 thereof.

FIGS. 2-4 show more fully the cutting ring element 10, which is generally comprised of a ring-like structure 54. The ring-like structure 54 has an outer circumferential edge 56 and an inner circumferential edge 58, and has a radially-extending first surface 60 and an opposing, radially-extending second surface 62. When positioned in a pump, as illustrated in FIG. 1, the second surface 62 is oriented away from the impeller 28 and is positioned against the backplate 30. The first surface 60 is oriented, when positioned in the pump 12, toward the impeller 28 and is positioned adjacent the impeller 28 as seen in FIG. 1. A plurality of channels 64 extending through the ring-like structure 54 provide attachment structure, such as for receiving a bolt or other fastening device, to secure the cutting ring element 10 to the backplate 30 or pump casing. Other means of attachment may be equally suitable.

The ring-like structure 54 is configured with at least one cutting member 66 that extends outwardly from the first surface 60 of the ring-like structure 54. In the embodiment depicted in FIGS. 2-5, the cutting ring element 10 is constructed with a plurality of cutting members 66. As described more fully hereinafter, the cutting members 66 are positioned and configured to interact with cutting structures 50 positioned on the drive side of the impeller 28 to effect cutting and chopping of solids that move to the rear portion 48 of the impeller 28. Accordingly, the diameter of the ring-like structure 54 is selected to coincide with the diameter of the impeller 28 such that the cutting members 66 of the cutting ring element 10 and the cutting structures 50 of the impeller 28 are located near the outer periphery of the impeller 28, as shown in FIG. 1 and described further below.

The cutting members 66 may be of any suitable size, shape, configuration and number that provides a cutting action in tandem with the cutting structures 50 associated with the impeller 28. By way of example only, the cutting members 66 illustrated in FIGS. 2-4 comprise two upwardly extending cutter teeth 70 which are separated by a slot 72 therebetween.

Figure 6:
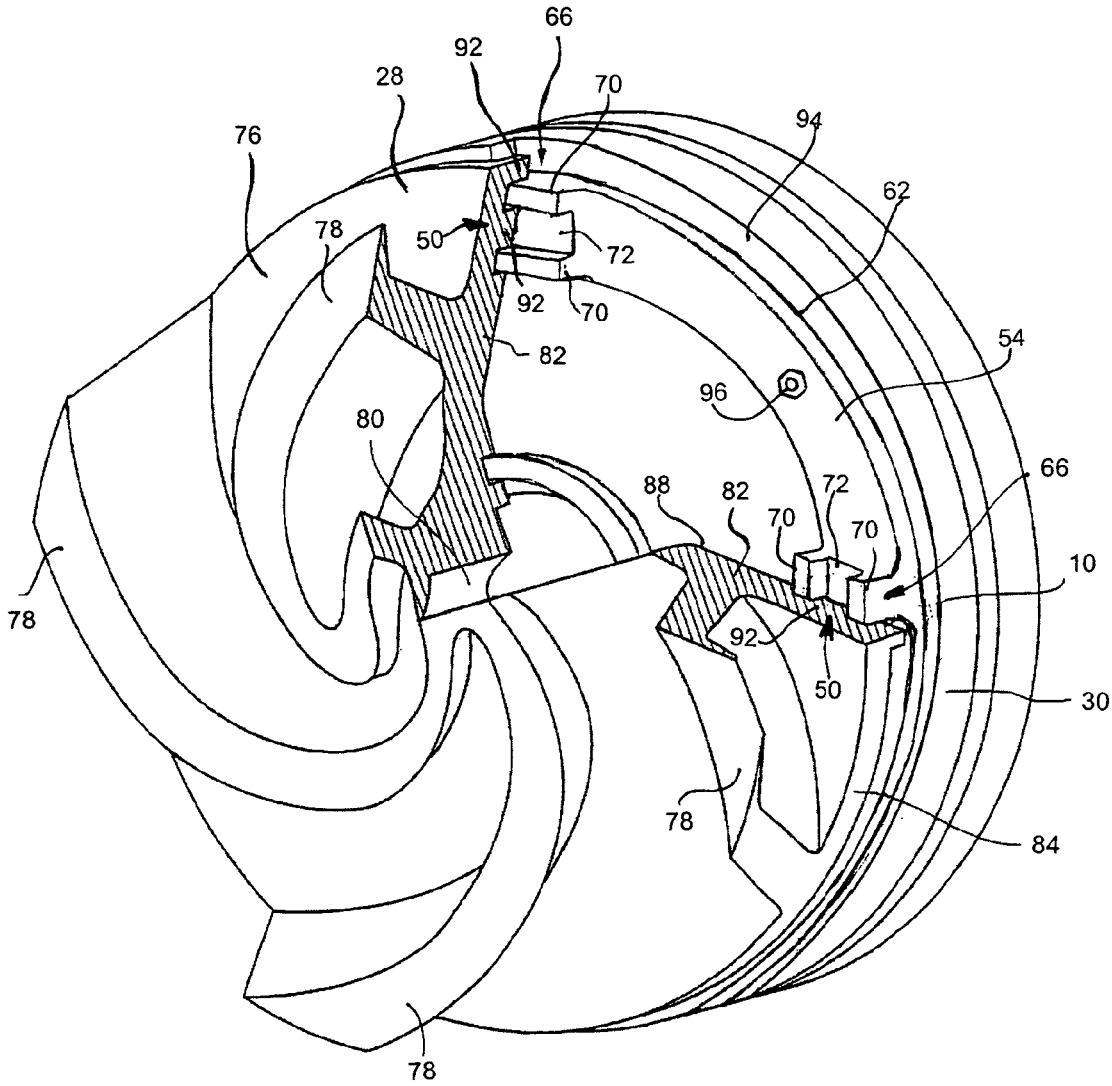
FIG. 6 is a perspective view of the cutting ring element attached to a back plate and shown in relative position to an impeller having cutting structures on the drive side of the impeller to illustrate the interaction of the cutting ring element to the cutting structures of the impeller.

FIG. 6 best illustrates the positioning of the cutting ring element 10 to the impeller 28 and the interaction of the cutting devices associated with each. In this view, it can be seen more clearly that the suction side 76 of the impeller 28 comprises a plurality of vanes 78 which radiate outwardly from the eye 80 of the impeller 28. In this particular embodiment of an impeller 28, the impeller 28 is formed with a shroud 82 which is oriented to be positioned adjacent the back plate 30, or oriented toward the drive side of the pump when assembled in the pump. The vanes 78 extend axially outwardly from the shroud 82 in a direction away from the back plate 30. The shroud 82 has a circumferential edge 84 which defines the periphery of the impeller 28.

The rear surface 88 of the shroud 82 of the impeller 28 is oriented toward the back plate 30 and is configured with one or more cutting structures 50 that are positioned near the periphery of the impeller 28. The cutting structures 50 are sized, shaped and configured in any suitable manner to intermesh with the cutting members 66 of the cutting ring element 10. As shown in FIG. 6 by way of example only, the cutting structures 50 of the impeller 28 may be comprised of cutter teeth 92 which intermesh with the cutter teeth 70 and slot 72 of the cutter ring element 10. The cutting structures 50 of the impeller 28 may be associated with expeller vanes extending outwardly from the rear surface 88 of the shroud 82.

As further shown in FIG. 6, the second surface 62 of the cutting ring element 10 is positioned against the front face 94 of the back plate 30 and is secured in place by suitable means, such as the positioning of bolts 96 through the ring-like structure 54 and the back plate 30. The cutting ring element 10 is sized in diameter so that the cutting members 66 are positioned at or near the periphery of the back plate 30 and positioned to intermesh with the cutting structures 50 located near the periphery of the impeller 28.

The interaction or intermeshing of the impeller cutter teeth 92 and the cutting members 66 of the cutting ring element 10 provides a cutting action on any debris that begins to infiltrate between the rear portion 48 of the impeller 28 and the back plate 30. The cutting action, most importantly, takes place in proximity to the periphery of the impeller 28 and back plate 30, thereby reducing the likelihood that debris will infiltrate all the way to the center of the impeller 28 near the drive shaft 22 and sealing mechanism 36.

The cutting ring element 10 may be made by casting, machining or by any other method known in the pump manufacture industry, and is preferably made of hardened material suitable for pump construction and use, especially use in slurry or chopper type pumps. The cutting ring element 10, or at least each cutting member 66 extending from the ring-like structure 54, is most suitably hardened by known methods in the art to render the cutting members 66 resistant to wear, thereby extending the service life of the cutting members 66. In normal operation, however, the interaction between the impeller cutter structures 50 and the cutting members 66 of the cutting ring element 10 cause an eventual wearing of both, and a gap forms between the interacting cutting devices. The impeller 28 may then be axially adjusted relative to the back plate 30 to lessen the gap between the impeller cutter structures 50 and the cutting members 66 of the cutting ring element 10.

Eventually with continued operation, however, the cutter devices of both the impeller 28 and the cutting ring element 10 become sufficiently worn so that the cutting ring element 10 must be replaced, as well as possibly the impeller 28. The construction of the cutting ring element 10 renders replacement of the cutting members 66 quick and easy, and very cost effective, over other cutting structures.

The cutting ring element of the present invention is particularly suited for use in centrifugal pumps of the chopper type, but may be adapted for use in any type of centrifugal or slurry pump. Because the configuration of chopper pumps, and centrifugal pumps in general, vary widely, it will be apparent to those of skill in the art what modifications may be required to adapt the invention to various pumps. Thus, reference herein to particularly described or illustrated details of the invention are merely by way of example and not by way of limitation.

What is claimed is:

1. A centrifugal pump having a pump casing and a drive mechanism, comprising:

a pump casing;

an impeller having a central opening for attachment to a drive mechanism of a pump, a periphery and a drive side on which said central opening is located, said impeller having at least one vane radiating outwardly from a central axis of said impeller;

at least one cutting structure positioned on said drive side of said impeller located proximate said periphery of said impeller; and a cutting ring element positioned adjacent said drive side of said impeller and having an outer circumferential edge and an inner circumferential edge that is radially distanced from said central opening and positioned proximate said periphery of said impeller, said cutting element ring having at least one cutting member extending between said outer circumferential edge and said inner circumferential edge to be radially distanced from said central opening of said impeller and positioned adjacent said at least one cutting structure of said impeller at said periphery of said impeller, said at least one cutting member being structured and positioned to interact with said at least one cutting structure of said impeller at said periphery of said impeller to effect cutting of solids near the periphery, and on said drive side, of said impeller.

2. The centrifugal pump of claim 1 wherein said cutting ring element has a diameter selected to position said at least one cutting member in proximity to the periphery of said impeller.

3. The centrifugal pump of claim 1 wherein said cutting ring element is secured to said pump casing.

4. The centrifugal pump of claim 1 further comprising a back plate positioned adjacent said drive side of said impeller, and wherein said at least one cutting member positioned adjacent said at least one cutting structure of said impeller is positioned on said back plate.

5. The centrifugal pump of claim 1 wherein said at least one cutting member further comprises a plurality of cutting members positioned about said cutting ring element and positioned to interact with said cutting structures of said impeller in proximity to said periphery of said impeller.

6. The centrifugal pump of claim 5 wherein each said cutting member further comprises spaced apart cutter teeth extending axially from said cutting ring element toward said impeller.

7. The centrifugal pump of claim 1 further comprising a back plate positioned within said pump casing adjacent said drive side of said impeller, and wherein said at least one cutting ring element is secured to said back plate and positioned between said drive side of said impeller and said back plate.

* * * * *